United States Patent [19]

Gottling et al.

[11] Patent Number: 4,531,548

[45] Date of Patent: Jul. 30, 1985

[54] APPARATUS TO VARY THE FORCE EXERTED ON AN ACTUATOR MECHANISM

[75] Inventors: Helmut Gottling, Isernhagen; Walter Brausfeld, Hanover, both of Fed. Rep. of Germany

[73] Assignee: WABCO Steuerungstechnik GmbH, Hannover, Fed. Rep. of Germany

[21] Appl. No.: 557,572

[22] Filed: Dec. 2, 1983

[30] Foreign Application Priority Data

Dec. 4, 1982 [DE] Fed. Rep. of Germany ..... 3244920

[51] Int. Cl.[3] ..... F15B 13/16; F15B 13/044

[52] U.S. Cl. ..... 137/627.5; 251/30; 251/63.4; 91/387; 91/530; 92/84; 92/146

[58] Field of Search ..... 92/84, 146; 91/530, 91/387; 251/63.4, 30; 137/627.5

[56] References Cited

U.S. PATENT DOCUMENTS

| | | | |
|---|---|---|---|
| 1,782,595 | 11/1930 | Amsler | 92/146 |
| 3,429,150 | 2/1969 | Plechac et al. | 92/84 |
| 3,593,620 | 7/1971 | Scotts | 92/146 |
| 3,608,434 | 9/1971 | Hillberry | 92/146 |

FOREIGN PATENT DOCUMENTS

| | | | |
|---|---|---|---|
| 602663 | 3/1926 | France | 92/84 |
| 408664 | 4/1934 | United Kingdom | 92/84 |

*Primary Examiner*—Paul E. Maslousky
*Attorney, Agent, or Firm*—G. E. Hawranko

[57] ABSTRACT

A force transmitting fluid actuator for use with a control device wherein an actuator member, movable within an actuator housing, actuates the control device due to the urging force of a plurality of pistons which can be selectively pressurized in unitary increments. The plurality of pistons are disposed within pressure chambers formed in the actuator housing in a symmetrical ring-shaped arrangement concentric to a single pressure chamber disposed on the vertical axis of the housing. A number of passageways interconnect the plurality of pressure chambers to form groupings of pressure chambers which act simultaneously in response to operation of a solenoid valve associated with each passageway. In addition to the symmetrical arrangement of the pressure chambers, the valve and passageway arrangement provide for a symmetric pressurization of the pressure chambers thereby resulting in a balanced force being exerted on the actuator. The amount of force each piston can exert on the actuator is limited by a piston stop designed to contact a portion of the housing while the actual piston force is transmitted by a spring disposed between each piston and the actuator. In this manner, fluctuations in the pressurizing force are not transmitted from the piston to the actuator.

15 Claims, 3 Drawing Figures

APPARATUS TO VARY THE FORCE EXERTED ON AN ACTUATOR MECHANISM

BACKGROUND OF THE INVENTION

The invention relates to an apparatus to change the force exerted on an actuator mechanism.

Such an apparatus is already known from the German Patent Publication DE-OS No. 17 76 078. On this apparatus, there are several control pistons operated by a pressure medium, which act directly on the actuator mechanism by means of their piston rods. The control pistons exhibit different effective surfaces. Thus, by the selection of the number of control pistons and/or the selection of the appropriate size of the effective surface which is acted on by the pressure medium, different forces can be produced, which are exerted by the control pistons on the actuator mechanism. In the known apparatus, the actuator mechanism is used to operate a pilot valve for a servo-motor. The restoring force acting on the actuator is the pressure controlled by the pilot valve.

Since the forces exerted by the control pistons on the actuator are a function of the pressure of the pressure medium acting on the control piston, the specified forces can only be achieved if a constant pressure of the pressure medium acting on the control pistons is maintained. This means that the precision of control of the forces exerted on the actuator is a function of the constancy of the above-mentioned pressure.

SUMMARY OF THE INVENTION

The object of the invention, therefore, is the creation of an apparatus to vary the force on an actuator mechanism which is independent of fluctuations of the control pressure.

A further object of the invention is to provide such an apparatus which can utilize identical components, such as the control pistons, thereby facilitating manufacture and maintenance operations.

Yet another object of the invention is to allow for precisely controlled force changes of equal, incremental stages.

Still another object of the invention is to provide an arrangement of the control pistons such that, for each change in force, the effective control piston or pistons act on the actuator mechanism symmetrically, thereby preventing binding or cocking of the actuator in its travel.

An even further object of the invention is to allow for modifying the transition between the individual control stages of the forces acting on the actuator mechanism such that, instead of equal incremental stages, the force changes can be graduated.

Briefly, the invention consists of an actuated portion such as, for example, a pressure-regulating valve, a force-changing portion and an actuator located therebetween. The force-changing portion consists of fifteen pressure medium chambers, each having a piston-and-spring configuration disposed therein. The pressure medium chambers are arranged in the shape of three concentric rings symmetric about the central axis of the housing. In the center is one pressure medium chamber; an inner ring surrounds this center chamber and consists of six pressure medium chambers. An outer ring surrounds the inner ring and consists of eight pressure medium chambers. The chambers are arranged into four groupings and are connected via a series of four channels such that, a first channel leads to one chamber, a second channel leads to a grouping of two chambers, a third channel leads to a grouping of four chambers, and the fourth channel leads to a grouping of eight chambers. Four solenoid valves operate to allow the flow of fluid pressure to the respective channels.

A seal, disposed between the force-changing portion and the actuator, serves to limit the stroke of the control pistons such that, a specific force is exerted by each control piston regardless of fluctuations in the pressure medium. Each control piston has associated with it, a spring which extends through a specific opening in the seal and contacts the actuator, thereby transmitting the force of the piston to the actuator. The springs can all be of equal spring constants which would result in force-changes in equal incremental changes; or, the spring constants can be modified resulting in force-changes in graduated stages.

A discharge valve, or like device, can be included with the actuated portion to allow for venting or exhaust operation.

DESCRIPTION AND OPERATION

Figure 1:
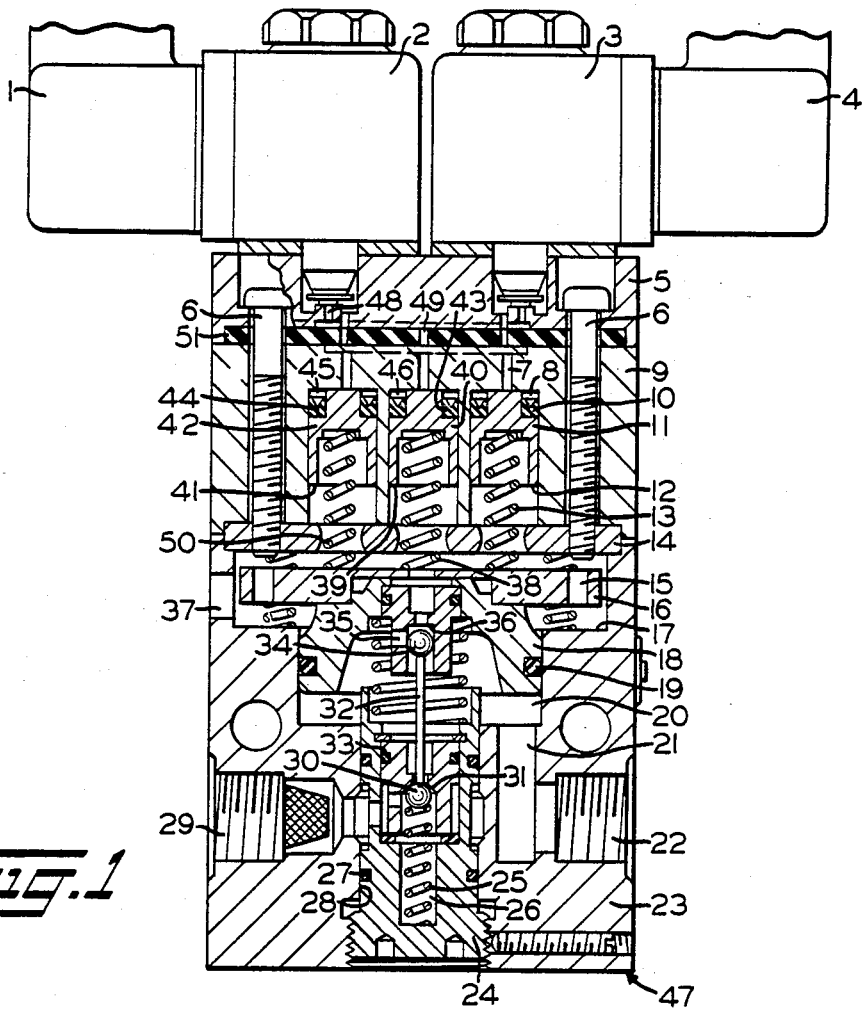
FIG. 1 is a sectional view of a pressure-regulating valve with an apparatus to change the level of the discharge pressure constructed in accordance with the invention.

The pressure-regulating valve 47, illustrated in FIG. 1, has a pressure medium inlet 29 and a pressure medium outlet 22 located in a valve housing 23 The pressure medium inlet 29 is connected with a pressure medium source (not shown) and the pressure medium outlet 22 is connected with a consumer (not shown). Located in a first bore 28, running in the direction of the longitudinal axis of the valve housing 23, is a valve case 24 equipped with two valve seals 27 and 33. The valve case 24 has a first valve seat 31 which, together with a first valve-closing body 30, forms a first valve or inlet valve 30, 31 by means of which the pressure medium inlet 29 can be connected with the pressure medium outlet 22. The first valve body 30 is loaded by a first valve spring 25, which is guided in a spring bore 26, in the direction of the first valve seat 31. The pressure medium outlet 22 is in communication, via a second bore 21, with a control chamber 20. The control chamber 20 is delimited by a piston 18 equipped with a sealing ring 19. On the side of the piston 18 away from the control chamber 20, there is a disc-shaped crosspiece attached, which serves as an actuator mechanism 16, which, when there is a stroke of the piston 18 in the direction of the control chamber 20, can be brought into contact with a shoulder serving as a stop 17 in the housing portion which holds the actuator mechanism 16. The side of the housing recess opposite the stop 17 is closed off by a disc-shaped seal 14. There is a graduated bore located in the center of the piston 18, which is designed as a second valve seat 36 in the region of the graduation. A second valve sealing body 34, together with the second valve seat 36, forms a second valve 34, 36, serving as a discharge valve, by means of which the space above the piston 18 can be connected with the control chamber 20. The second valve 34, 36 also serves as the discharge valve for the control chamber 20. The second valve sealing body 34 of the second valve 34, 36 is connected, by means of a rod 32, with the first valve sealing body 30 of the first valve 30, 31.

Attached by means of screws 6 to the housing 23 of the pressure-regulating valve is a control housing 9, equipped with a cover 5 of an apparatus for the activation of the actuator mechanism 16. Between the cover 5 and the control housing 9, there is a seal 51.

Inside the housing 9, there are fifteen cylindrical pressure medium chambers, of which only three pressure medium chambers 8, 46 and 45 are shown in FIG. 1. The pressure medium chambers are arranged symmetrically around the central axis of the actuator mechanism 16. The pressure medium chamber 8 has contained therein a first control piston 11 equipped with a sealing ring 10, which control piston can be displaced against the force of a spring 13 in the direction of the actuator mechanism 16. On its side, away from the pressure medium chamber 8, the control piston 11 has a projection which serves as a stop 12. The spring 13 is conducted through the recess provided in the disc-shaped seal 14, and its end away from the control piston 11 is in contact with the actuator mechanism 16. A second control piston 40, equipped with a sealing ring 43, is contained within the pressure medium chamber 46. Between the side of the second control piston 40, turned away from the pressure medium chamber 46 and the actuator mechanism 16, there is a spring 38. The second control piston 40 has, on its side away from the spring 38, a projection serving as a stop 39, which when the control piston 40 makes a stroke in the direction of the actuator element 16, comes in contact with the disc-shaped seal 14. The pressure medium chamber 45 has contained therein a third control piston 42, equipped with a sealing ring 44, which can be moved against the force of a spring 50 in the direction of the actuator mechanism 16. The third control piston 42 also has a projection designed as a stop 41, which interacts with the disc-shaped seal element 14. The springs arranged between the control pistons and the actuator element 16 are identical. To be able to change the stroke of the control pistons, it is conceivable that the stops formed by the projections of the control pistons and the seal could be modifiable, i.e., adjustable.

This can be done, for example, by an arrangement of spacers between the seal 14 and the springs 13, 38, 50 which could compensate for manufacturing tolerances and variances in the spring constants. It is possible to provide adjustable stops between the control pistons and the bottom of the corresponding pressure medium chambers. On the cover 5 of the housing 9, there are four solenoid valves 1, 2, 3, 4. The solenoid valves (1 through 4) are used to control the fifteen pressure medium chambers. By means of pressure medium lines (not shown) the solenoid valves are connected with a pressure medium source (not shown). The solenoid valves (1 through 4) are electrically controlled by means of a 16-position switch (not shown). As shown in FIG. 1, the pressure medium chamber 45 is connected by means of a bore 48 and a corresponding hole in the seal 51 with the solenoid valve 2. The solenoid valve 3 is in communication via a channel 7 and a corresponding hole in the seal 51 with the pressure medium chamber 8.

Figure 2:
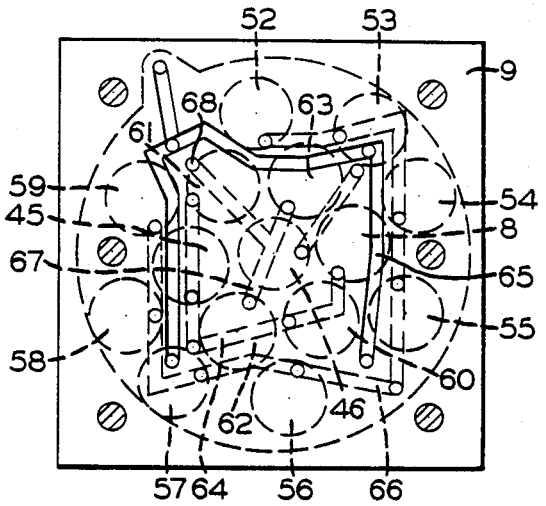
FIG. 2 is an overhead view of the layout of the force-changing apparatus constructed in accordance with the invention

FIG. 2 shows the pressure medium layout of the apparatus illustrated and described in FIG. 1 to modify the control pressure in cross-section. For the sake of clarity, the parts indicated in FIG. 1 are identified by the same numbers in this Figure.

In the housing 9, there are fifteen cylindrical pressure medium chambers 52, 53, 54, 55, 56, 57, 58, 59, 8, 60, 45, 61, 62, 63 and 46, in which control pistons (not shown) can be displaced against the force of springs (not shown). The pressure medium chambers are arranged symmetrically around the central axis of the actuator element 16 (shown in FIG. 1). The first pressure medium chamber 46 is centrally-located and is in communication by means of a first channel (not shown) with the first solenoid valve (shown in FIG. 1). Two other pressure medium chambers 62 and 63 are arranged symmetrical to one another and lie on a hypothetical axis running through the center. The two pressure medium chambers 62 and 63 are in communication with one another via a channel 67, which is connected via a second channel 68 to the second solenoid valve (shown in FIG. 1). Four pressure medium chambers 8, 60, 45 and 61, connected via a third channel 64 and among one another, are arranged in relation to the pressure medium chambers 62 and 63, so that together with these, they form an inner ring around the centrally-located pressure medium chamber 46. The four pressure medium chambers 8, 60, 45 and 61 are connected via the third channel 64 with the solenoid valve 3 (shown in FIG. 1). An outer ring around the centrally-located pressure medium chamber 46 is formed by the remaining pressure medium chambers 52, 53, 54, 55, 56, 57, 58 and 59. These pressure medium chambers are connected with one another via a fourth channel 66. Another channel 65, connected to the chambers 57 and 53, leads to a solenoid valve 4 (shown in FIG. 1) and connects the outer ring of the pressure medium chambers to the fourth solenoid valve 4. The branches leading from the individual channels to the corresponding pressure medium chambers are shown in dotted lines.

With reference to FIG. 2, the operation of the apparatus is explained in more detail below on the basis of FIG. 1.

It is assumed that a pressure of 2 bar is to be established by the pressure-regulating valve 47. For this purpose, the 16-position switch is set to position one, and thus a voltage is applied to the solenoid valve 1 which is connected to the centrally-located pressure medium chamber 46.

The first solenoid valve 1 opens, and pressure medium flows from the pressure medium source into the pressure medium chamber 46. The control piston is displaced by the pressure accumulating in the pressure medium chamber 46 in the direction of the actuator element 16, until its stop 39 comes in contact with the seal 14. By means of the second valve or discharge valve 34, 36, the space beneath the control piston 40 is evacuated. The spring 38, located between the actuator element 16 and the control piston 40, upon the downward movement of the control piston 40, brings about a stroke of the piston 18 connected with the actuator element 16 in the direction of the control chamber 20. The stroke of the piston 18 is ended when the actuator element 16 comes in contact with the stop 17. During the downward movement of the piston 18, the discharge valve 34, 36 assumes the closed position, and the first valve 30, 31, which serves as the inlet valve, is placed in the open position by means of the rod 32. The pressure medium inlet 29 of the pressure-regulating valve is now in communication with the pressure medium outlet 22 via the inlet valve 30, 31. Fluid pressure flows from the pressure medium source to the consumer. The pressure accumulating in the control chamber 20 via the bore 21, which is in communication with the pressure medium outlet 22, displaces the piston 18 against the force of the spring 38 in the direction of the control piston 40. If the pressure consumer, and thus also the pressure in the control chamber 20, has reached a level which corresponds to the force of the spring 38 exerted in the opposite direction on the actuator element 16, the inlet valve 30, 31 assumes the closed position. The feed of fluid pressure to the consumer is interrupted. If the pressure to be controlled by the pressure-regulating valve should be increased to 8 bar, for example, then the 16-position switch is switched into position four. The solenoid valve 3, which is connected with the four pressure medium chambers 8, 60, 45 and 61, is placed in the open position, and the solenoid valve 1, which is connected with the centrally-located pressure medium chamber 46, is placed in the closed position. The control pistons 11, 42, located in the four pressure medium chambers 8, 60, 46 and 61, are displaced far enough in the direction of the actuator element 16 until their stops 12, 41 come in contact with the seal 14. The centrally-located pressure medium chamber 46 is simultaneously evacuated via the corresponding first solenoid valve 1, and the control piston 40 is displaced upward by the spring 38. As a result of the force of the springs 13, 50 of the four control pistons 11, 42, the actuator mechanism 16 and the piston 18 connected with it are displaced downward, as a result of the interference with the equilibrium of forces. The inlet valve 30, 31 again assumes the open position, and the consumer is again connected with the pressure medium source via the pressure medium outlet 22, the inlet valve 30, 31 and the pressure medium inlet 29. If the pressure in the consumer, and thus also the pressure in the control chamber 20, has increased to the point that equilibrium prevails between the opposing forces acting on the actuator mechanism 16, the inlet valve 30, 31, as a result of the continuous upward movement of the piston 18, assumes the closed position.

If the consumer is to be evacuated, then the 16-position switch is placed in the zero position. The four pressure medium chambers 8, 60, 45 and 61 are evacuated, and the control pistons 11 and 42 travel upward. The corresponding springs 13 and 50 relax. Since now the force exerted by the pressure in the control chamber 20 via the piston 18 on the actuator mechanism 16 predominates, the piston 18 continues to travel upward. The second valve 34, 36, which serves as the discharge valve, assumes the open position, and the consumer is evacuated via the pressure medium outlet 22, the second bore 21 and the control chamber 20, the discharge valve 34, 36 and the discharge outlet 37.

Depending on the number of simultaneously-controlled pressure medium chambers, the pressure to be established by the pressure-regulating valve 47 can be increased or decreased in stages. In this example, fifteen switch positions or pressure stages are possible. To prevent an accidental evacuation of the consumer if there is a failure of the control pressure, the solenoid valves connected with the pressure medium chambers can be designed as pulse valves.

Figure 3:
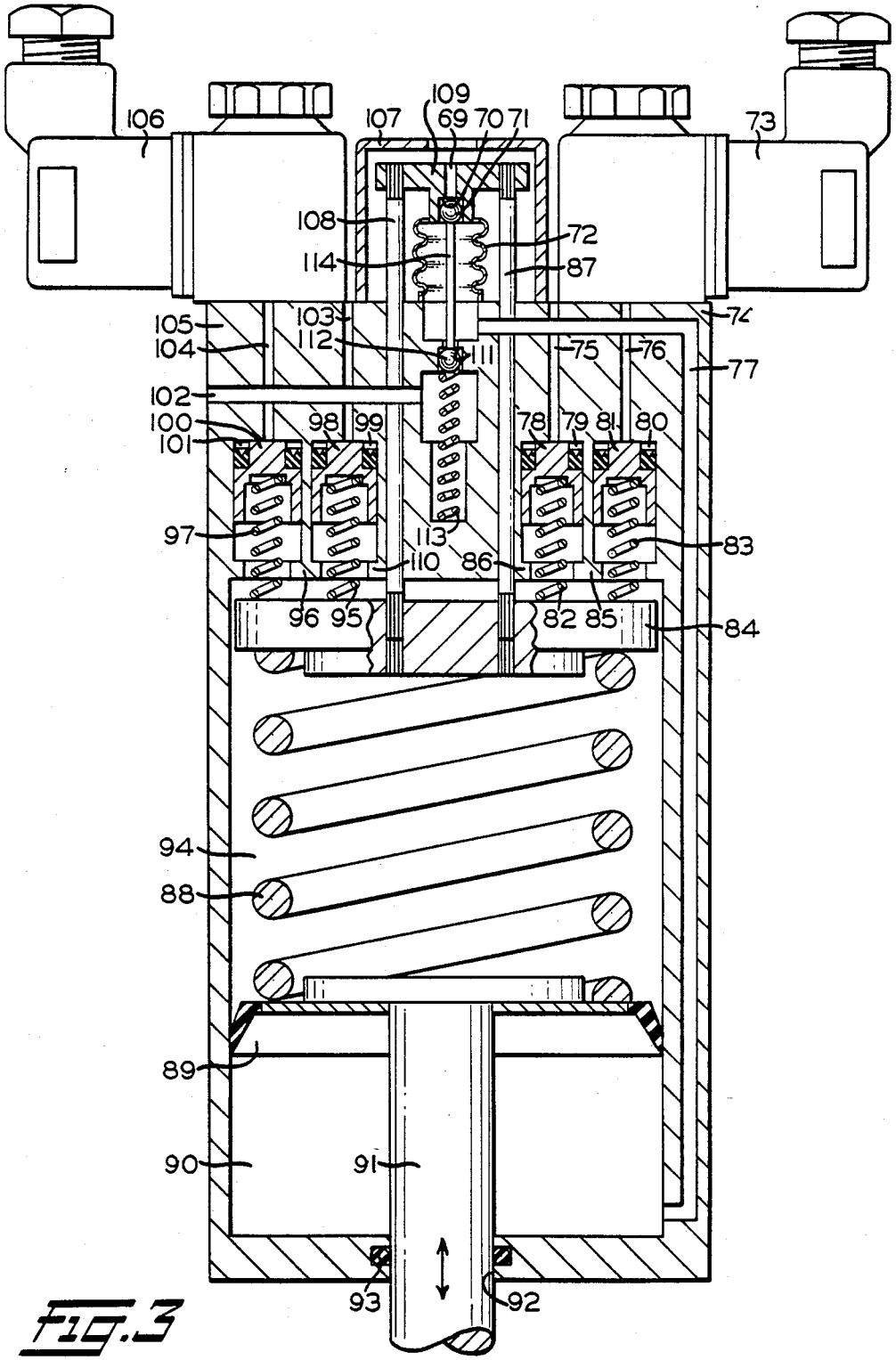
FIG. 3 is a sectional view of a working cylinder with an apparatus to control the distance travelled by the working piston constructed in accordance with the invention.

FIG. 3 shows a working cylinder whose piston position is specified by means of an apparatus for changing controller output.

In a cylinder 74, there is a working piston 89, which can move, connected with a piston rod 91. The piston rod 91 extends outside the cylinder 74 through an opening 92 made in the end wall of the cylinder 74 and equipped with a sealing ring 93. The working piston 89 divides the cylinder 74 into a working chamber 90 on the piston rod side and a spring chamber 94 located on the other side of the working piston 89 opposite the working chamber 90. In the spring chamber 94, there is a compression spring 88, which has one end attached to the working piston 89 and its other end on a disc-shaped actuator mechanism 84. The actuator mechanism 84 has, on its side away from the spring chamber 94, rods 87, 108, which are guided in corresponding holes provided in the cylinder cover 105. The rods 87, 108 extend through the cylinder cover 105 into a cup-shaped cap 107. On the free end of the rods 87, 108, connected with the actuator mechanism 84, a plate 109 is attached, which has a centrally-oriented hole 69 with a valve seat 70. Coaxial to the valve seat 70, there is another valve seat 111 in the cylinder cover 105. A double valve body 112, 114, 71 forms, with the valve seat 111, an inlet valve 111, 112, and with the valve seat 70 an outlet valve 70, 71. The double valve body 112, 114, 71 is supported by a spring 113 on the inlet valve seat 111. From the outlet of the inlet valve 111, 112, a pressure medium line 77 leads to the working chamber 90 of the cylinder 74. The inlet of the inlet valve 111, 112 is connected via a channel 102 with a pressure medium source (not shown). Between the plate 109 and the cylinder cover 105, there is a bellows 72. Several pressure medium chambers are located in the cylinder cover 105, but in the Figure, for simplicity's sake, only four pressure medium chambers 79, 80, 99 and 101 are illustrated. Each pressure medium chamber is bounded by a control piston 78, 81, 98 or 100. Each control piston 78, 81, 98 or 100 has a corresponding spring 82, 83, 95 or 97. The springs are attached on one end to the actuator mechanism 84 and on the other end to the corresponding control piston. The stroke of each control piston is limited in the direction of the actuator mechanism 84 by a stop 86, 85, 110 and 96.

The pressure medium chambers 79, 80, 99 and 101 are connected with solenoid valves by means of holes 75, 76, 103 and 104 in the cylinder cover 105.

For clarity's sake, the Figure shows only two solenoid valves 106 and 73. The solenoid valves are connected with a pressure medium source (not shown). By means of a multi-position switch (not shown), the solenoid valves are individually-connected with a voltage source.

If the working piston 89, and thus also the piston rod 91, are to be displaced by a given amount, then a switch pulse is sent to the solenoid valve 73, for example. The solenoid valve 73 opens, and thus connects the pressure medium chambers 79 and 99 with the pressure medium source. The pressure building up in the pressure medium chambers 79 and 99 displaces the control pistons 78 and 98 in the direction of the actuator mechanism 84. By means of the springs 82, 95, located between the actuator mechanism 84 and the control pistons 78, 98, the force exerted on the control pistons 78, 98 is transmitted to the actuator mechanism 84, and thus the actuator mechanism 84 is displaced in the direction of the working piston 89. During this displacement movement, the outlet valve seat 70, located on the plate 109 connected with the actuator mechanism 84, comes in contact with the double valve body 71, 114, 112 and carries it along with it. The outlet valve 70, 71 is now closed, and the inlet valve 111, 112 assumes the open position. Via the now open inlet valve 111, 112 and the pressure medium line 77, fluid pressure from the pressure medium source gets into the working chamber 90. The pressure which accumulates in the working chamber 90 displaces the working piston 89 against the force of the spring 88 in the direction of the actuator mechanism 84. If the force of the prestressed spring 88 has increased to the point that it overcomes the force of the springs 82, 95, loaded by the control pistons 78, 98, the actuator mechanism 84 is displaced against the force of the springs 82, 95. As soon as the forces of the springs 88 and 82, 95 exerted in opposite directions on the actuator mechanism 84 are in equilibrium, the inlet valve 111, 112 assumes the closed position. The fluid pressure feed to the working chamber 90 is now interrupted, and the working piston 89 stops in the position it then occupies.

If the working piston 89 is to return to its starting position, the pressure medium chambers 79, 99 are evacuated by means of the solenoid valve 73. The control pistons 78, 98 travel upward and the springs 82, 95 relax. Since now the force exerted by the spring 88 on the actuator element 84 predominates, the actuator mechanism 84 is again pushed upward. The outlet valve seat 70 lifts off the double valve body 71, 114, 112. The working chamber 90 is evacuated via the pressure medium line 77, the opened outlet valve 70, 71 and the outlet 69. The spring 88 brings the working piston 89 into its original position.

The more control pistons are acted upon by the pressure, the greater must be the opposing force of the spring 88, located between the piston 89 and the actuator element 84, to overcome the force of the springs 82, 83, 95 and 97 loaded by the control pistons. This means that the spring 88 must be more strongly prestressed by a longer stroke of the piston 89.

We claim:

1. A force transmitting fluid actuator for operating a control device, said force transmitting fluid actuator comprising:

(a) a housing having an actuator portion formed therein;

(b) an actuator member movable within said actuator portion;

(c) a plurality of pressure chambers formed in said housing adjacent said actuator portion and symmetrically-arranged about the vertical axis of said housing;

(d) a plurality of pistons movable within said plurality of pressure chambers such that a piston force is transmitted to a first side of said actuator upon movement of at least one of said plurality of pistons, said actuator is urged in a first direction corresponding to actuation of the control device;

(e) pressure supply means for selectively pressurizing said at least one of said plurality of pistons wherein such piston force is applied to said actuator in a balanced manner about said vertical axis;

(f) valving means for connecting said pressure supply means to said plurality of pressure chambers such that, said pressure supply means selectively pressurizes said plurality of pressure chambers in unitary increments; and (g) piston limiting means disposed between said plurality of pistons and said actuator member for limiting at least one of said plurality of pistons to a predetermined displacement independent of variations in the force exerted by said pressure supply means, said piston limiting means including a plurality of piston springs approximately corresponding in number to said plurality of pistons, said plurality of piston springs being disposed such that, at least a portion of such piston force is transmitted therethrough as a function of a preselected spring constant variable according to a selection of spring constants for each of said plurality of piston springs.

2. A force transmitting fluid actuator, as set forth in claim 1, wherein said valving means includes at least two passageways formed in said housing whereby a plurality of said symmetrically-arranged pressure chambers are interconnected to form at least two groupings of said plurality of pressure chambers.

3. A force transmitting fluid actuator, as set forth in claim 2, wherein symmetrically-arranged, interconnected groupings of said plurality of pressure chambers are arranged as concentric rings about said vertical axis.

4. A force transmitting fluid actuator, as set forth in claim 3, wherein said at least two groupings of said plurality of pressure chambers includes a first grouping having two pressure chambers and a second grouping having four pressure chambers, said first and said second groupings of pressure chambers being arranged as a first of said concentric rings wherein said first concentric ring is disposed in surrounding relationship to one of said pressure chambers disposed concentrically on said vertical axis.

5. A force transmitting fluid actuator, as set forth in claim 4, wherein said pressure chambers arranged in said first concentric ring are substantially equiangularly spaced around said first concentric ring.

6. A force transmitting fluid actuator, as set forth in claim 4, wherein a first of said at least two passageways communicates with said first grouping of said plurality of pressure chambers and a second of said at least two passageways communicates with said second grouping of said plurality of pressure chambers.

7. A force transmitting fluid actuator, as set forth in claim 6, further comprising a third grouping of said plurality of piston chambers having eight pressure chambers, said third grouping of said plurality of pressure chambers being arranged as a second of said concentric rings wherein said second concentric ring is disposed in surrounding relationship to said first concentric ring.

8. A force transmitting fluid actuator, as set forth in claim 7, wherein said pressure chambers arranged in said second concentric ring are substantially equiangularly-spaced around said second concentric ring.

9. A force transmitting fluid actuator, as set forth in claim 7, wherein said valving means further includes a third passageway in communication with said third grouping of said plurality of pressure chambers.

10. A force transmitting fluid actuator, as set forth in claim 9, wherein said pressure supply means includes a plurality of solenoid valves wherein at least one of said solenoid valves is connected to at least one of said passageways.

11. A force transmitting fluid actuator, as set forth in claim 10, wherein one of said plurality of solenoid valves is in communication with said pressure chambers disposed concentrically on said vertical axis.

12. A force transmitting fluid actuator, as set forth in claim 1, wherein said plurality of piston springs extend through a plurality of spring openings formed in a portion of said housing, said piston springs having one end contacting said actuator and a second end contacting said plurality of pistons, and a piston stop formed on each of said plurality of pistons such that, movement of said at least one of said plurality of pistons ceases upon contact between said piston stop and said housing portion containing said spring openings.

13. A force transmitting fluid actuator, as set forth in claim 1, further comprising a force-balancing means for urging said actuator in a second direction resulting in deactivation of the control device upon detecting a force on a second side of said actuator in communication with the control device equal to said piston force.

14. A force transmitting fluid actuator, as set forth in claim 13, wherein said force-balancing means includes a control chamber in communication with said control device and adjacent said second side of said actuator.

15. A force transmitting fluid actuator, as set forth in claim 14, wherein the control device is a regulating valve having an inlet valve and an outlet valve operably connected to said actuator such that, upon movement of said actuator in said first direction, said inlet valve is opened and said outlet valve is closed and, upon movement of said actuator in said second direction, said outlet valve is opened and said inlet valve is closed.

* * * * *